United States Patent [19]

Rosenthal

[11] 4,251,615

[45] Feb. 17, 1981

[54] VISCOSITY STABILIZED PHOTOCONDUCTIVE COATING MATERIAL AND SHEET MATERIAL USING SAME

[75] Inventor: Fritz Rosenthal, Phoenixville, Pa.

[73] Assignee: SCM Corporation, New York, N.Y.

[21] Appl. No.: 614,825

[22] Filed: Sep. 19, 1975

Related U.S. Application Data

[63] Continuation of Ser. No. 440,131, Feb. 5, 1974, abandoned.

[51] Int. Cl.[2] ..... G03G 5/022; G03G 5/08

[52] U.S. Cl. ..... 430/89; 430/135

[58] Field of Search ..... 96/1.5, 1.7, 1.8; 430/89, 135

[56] References Cited

U.S. PATENT DOCUMENTS

| | | | |
|---|---|---|---|
| 3,404,979 | 10/1968 | Bonjour | 96/1.8 |
| 3,649,263 | 3/1972 | Tubuko et al. | 96/1.8 |
| 3,672,885 | 6/1972 | Ort | 96/1.8 |
| 3,725,061 | 4/1973 | Verhille et al. | 96/1.8 |
| 3,756,843 | 9/1973 | Honjo et al. | 96/1.8 |
| 3,778,264 | 12/1973 | Arai et al. | 96/1.8 |

*Primary Examiner*—John D. Welsh

*Attorney, Agent, or Firm*—Armand G. Guibert; Milton M. Wolson

[57] ABSTRACT

Electrophotographic members prepared by coating a paper or film with a slurry of photoconductive metal-compound particles, e.g., zinc oxide particles, dispersed in a liquid vehicle containing a solution of resinous binder having carboxyl groups. Viscosity of the coating slurry is controlled and/or stabilized by incorporating into the slurry a viscosity stabilizing agent comprising a chelate precursor which forms with the binder a chelating agent having the property of complexing metal ions, e.g., zinc ions, by formation of a ring structure incorporating the metal ion. Suitable viscosity stabilizing agents include: ethylenediamine, diethylenetriamine, and ethylenediaminetetraacetic acid and its salts.

13 Claims, Drawing Figure

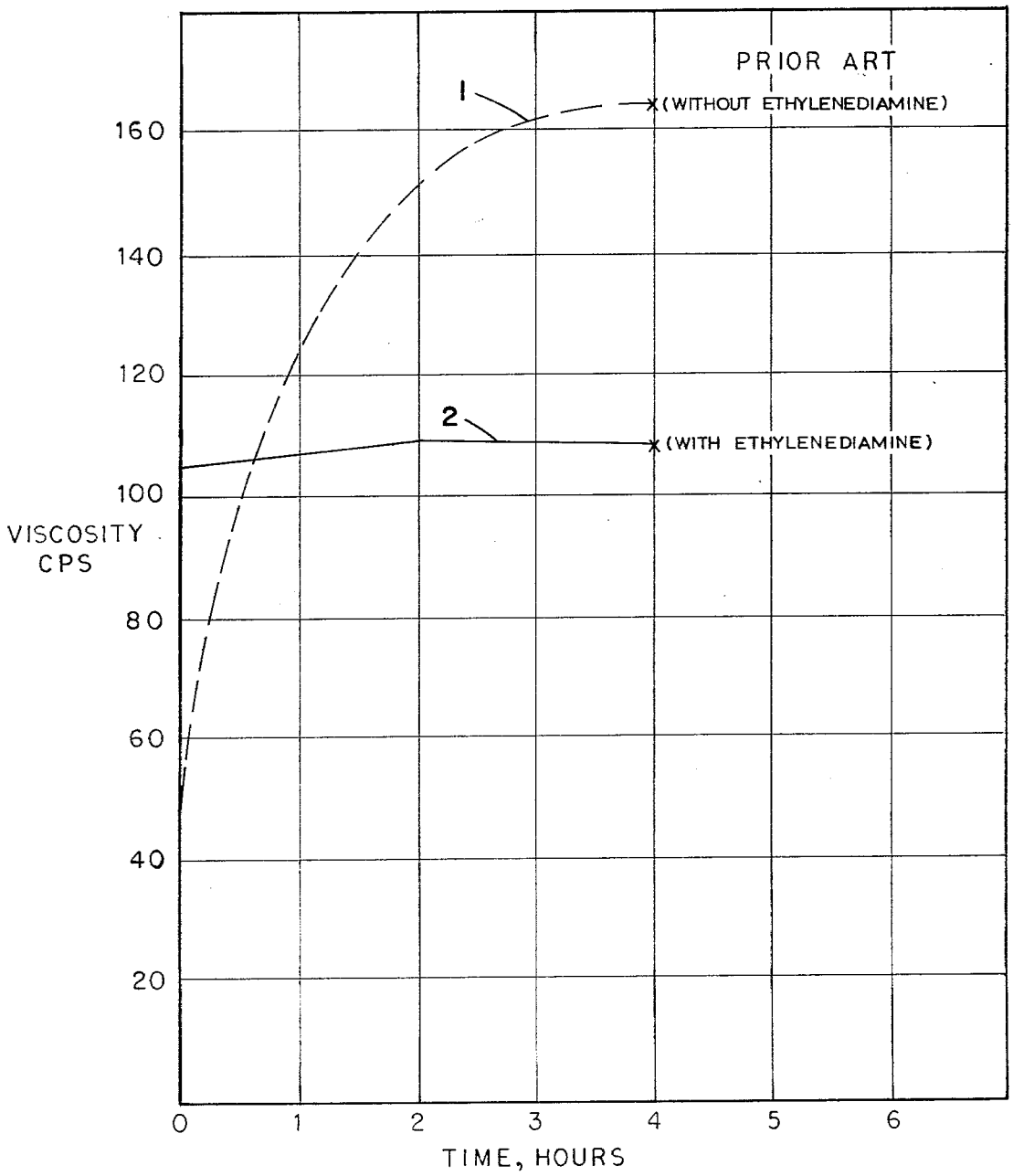
PRIOR ART
1
(WITHOUT ETHYLENEDIAMINE)
2
(WITH ETHYLENEDIAMINE)
160
140
120
100
80
60
40
20
VISCOSITY
CPS
0
1
2
3
4
5
6
TIME, HOURS

VISCOSITY STABILIZED PHOTOCONDUCTIVE COATING MATERIAL AND SHEET MATERIAL USING SAME

This is a continuation of application Ser. No. 440,131, filed Feb. 5, 1974, now abandoned.

BACKGROUND OF THE INVENTION

The present invention relates in general to photoconductive coating formulations containing dissolved resinous binders for use in coating sheet material to produce electrophotographic members.

DESCRIPTION OF THE PRIOR ART

In the known electrophotographic processes, a solid substrate (such as conductive paper, conductive film, or conductively coated sheet material) which has been coated with a photoconductive surface layer, is electrostatically charged in the absence of light. The charged surface is exposed to a light source, such as actinic radiation reflected from a printed surface or transmitted through a transparency, which serves to discharge the expose area of the photoconductive layer while having no effect on the unexposed areas of the layer which is thus retained in the form of an electrostatic image. The exposed layer is contacted with an electrostatically charged development powder or dispersion which clings to the charged areas, but does not adhere to the uncharged, i.e., exposed areas. The visible image which is thus formed may then be transferred to another surface and fixed thereon in known fashion, resulting in a positive or negative print, or—if desired—the image may be fixed directly to the solid substrate itself, e.g., by heat fusing.

It is thus evident that proper selection of a photoconductive system is essential for a successful electrophotographic operation. Among the properties which must be exhibited by such photoconductive materials are included: the ability to accept an electrostatic charge; the ability to hold a charge for a period of time in the absence of light, without exhibiting a rapid rate of charge decay; the ability to provide the fixed or developed sheets with excellent print density; the ability to provide an efficient dispersing medium for the pigment particles; inertness of the binder toward the pigment which is being utilized; and the ability to be readily coated on a solid substrate.

A frequently utilized photoconductive system comprises the combination of a zinc oxide pigment and a polyvinyl acetate homopolymer binder. This system, however, does not exhibit the aforementioned properties to an optimum level. Statistically, it has been found that charge acceptance is enhanced by presence of carboxyl groups in the polymer chain. Improved charge acceptance is of particular importance in view of the prevailing trend to reduce the weight of photoconductive coating for reasons of economy.

The carboxyl groups in the resin are not inert, however, toward the zinc oxide pigment in the coating system. Upon dispersing zinc oxide in a carboxylic resin dissolved in an organic solvent, such as toluene, there is a gradual reaction between zinc oxide and the carboxyl groups of the resin, leading to the formation of zinc salts of organic acids. By this reaction, the zinc atoms previously bound to oxygen are converted to positively charged zinc ions. The formation of zinc ions, dispersed in organic solvents, is manifested by an increase in viscosity. The viscosity of the zinc oxide/resin dispersion increases rapidly during the first hour, and reaches a plateau after 3 hours. Depending upon the concentration of carboxyl groups in the resin, the increase in viscosity may continue, however, for periods exceeding three hours and may reach values of viscosity considerably higher than 160 cps (centipoises).

From a manufacturing standpoint, a photoconductive coating dispersion having unstable viscosity is highly undesirable. For uniformity of application of such coatings to a substrate, the flow properties of the coating dispersion should be constant within a very narrow range. The tolerance toward change in viscosity is being narrowed further as a result of the prevailing trend toward higher coating machine speeds. The higher the speed, the more difficult it is to make machine adjustments to maintain the proper laydown and weight of the photoconductive coating.

SUMMARY OF THE PRESENT INVENTION

The principal object of the present invention is to improve the viscosity stability of the photoconductive coating dispersion to such an extent as to permit perfect laydown and uniform weight of the coating as applied on a production paper or film coater at high machine speed.

In one feature of the present invention, a viscosity stabilizing agent is added to the coating formulation which will form a chelate by complexing the zinc ions, whereby the viscosity remains practically unchanged for at least four hours after preparing the dispersion.

In another feature of the present invention, the viscosity stabilizing agent is one which is reactive with the carboxyl groups of the resinous binders to form the chelate as a reaction product in situ and is selected from a group consisting of ethylenediamine and diethylenetriamine.

In another feature of the present invention, the amount of viscosity stabilizing agent incorporated into the coating slurry is within the range of the stoichiometric quantity required for reaction with the carboxyl groups of the resinous binders.

In another feature of the present invention, the chelating agent incorporated in the coating formulation for stabilizing viscosity is selected from the group of ethylenediaminetetraacetic acid and salts thereof.

Other features and advantages of the present invention will become apparent upon a perusal of the following specification taken in conjunction with the accompanying drawing wherein:

BRIEF DESCRIPTION OF THE DRAWING

The FIGURE is a plot of viscosity in centipoises (cps) v. time in hours showing the effect of a stabilizing agent on viscosity of a zinc oxide coating dispersion as contrasted with the viscosity of such dispersion without the stabilizing agent, i.e., as in the prior art.

DESCRIPTION OF THE PREFERRED EMBODIMENTS

In the present invention, a viscosity stabilizing agent such as a chelate precursor is incorporated into the paper or film coating formulation comprising a dispersion of photoconductive zinc oxide particles in a volatile vehicle such as toluene, which further contains a solution of a resinous binder of the type having carboxyl groups. In one example, the viscosity stabilizing agent reacts with the carboxyl groups of the resin binder to produce the chelating agent. The amount of the viscosity stabilizing agent, such as ethylenediamine, may vary from the stoichiometric quantity needed to react the carboxyl groups of the resinous binder, to about a 5 molar excess of that stoichiometric quantity. The effect of incorporation of the viscosity stabilizing agent (ethylenediamine) on the viscosity of a zinc oxide coating mix is shown graphically by curve 2 of the drawing, which shows that the viscosity (measured with a Brookfield Viscosimeter, Spindle 2) remains practically unchanged for at least 4 hours after preparing the mix, whereas the same mix without incorporation of ethylenediamine (curve 1) has a viscosity which slowly increases to 160 cps at 4 hours after preparing the mix.

It is postulated that the effectiveness of ethylenediamine as a viscosity stabilizer is based on its reaction with the carboxyl groups of the resin leading to the in situ formation of a chelating agent, such as ethylenediaminetetraacetic acid:

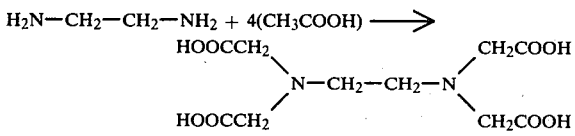

Such chelating agents have the property of complexing metal ions by the formation of a ring structure incorporating the metal ion. In contrast to the relatively slow reaction between zinc oxide and carboxyl groups, as evidenced by the viscosity increase over a period of hours, the reaction for complexing the zinc ions is fast as evidenced by the observed stability of the viscosity.

Diethylenetriamine also is capable of forming a chelate with the carboxyl groups of the zinc oxide binders, resulting in viscosity stability as described above. The next homolog of this polyamine series, triethylenetetramine is not capable of forming a chelate; experiments have shown that its incorporation into the zinc oxide/resin dispersion will not result in viscosity stability.

Others have used amines in photoconductive coatings to improve the speed and charge acceptance of such coatings as disclosed by U.S. Pat. Nos. 3,250,613 and 3,271,143. Two of the amines respectively disclosed therein—namely, n-butylamine and dimethylaniline—have been tested as additives to zinc oxide binders containing carboxyl groups. Viscosity stability was not accomplished because these amines cannot form chelating agents in situ to form chelates with zinc ions.

So far as the quantity of ethylenediamine or diethylenetriamine required for viscosity stability is concerned, this can be computed from the acid value of the resin, determined by titration with alkali, for example. It has been found that maximum stable viscosity is obtained when a 0.5 molar excess of ethylenediamine or diethylenetriamine is used. At a higher excess of these additives, viscosity stability is achieved at a lower value of viscosity. This makes it possible to adjust a coating mix to a predetermined level of viscosity which can be maintained for prolonged production runs on a high-speed coating machine without the necessity of making machine adjustments to compensate for viscosity fluctuations. As an alternative to reacting the viscosity stability additive with the carboxyl groups of the binder to produce the chelating agent, a chelating agent or its salts is added to the coating formulation. The salt reacts with the free acid components of the resin binder to form the chelate for stabilizing viscosity. A suitable salt of a chelating agent is tetrasodium salt of ethylenediaminetetraacetic acid, such as that marketed by Dow Chemical Co., Midland, Mich., under the trademark "Versene".

In a typical coating formulation, the mix has a zinc oxide pigment to binder ratio of 8:1 by weight where the binder comprises a mixture of 85 parts of a commercial vinylacetate copolymer (26–1205 made by National Starch and Chemical Corporation, New York, N.Y.) and 15 parts of a commercial acrylate copolymer (E-203 made by De Soto Inc., Des Plaines, Ill.). A conventional solution of a dye sensitizer is preferably admixed with the zinc oxide in a toluene slurry prior to admixing of the binder resins. The chelate precursors such as ethylenediamine and diethylenetriamine are added to the toluene slurry after dye sensitizing the zinc oxide particles. On the other hand, if Versene (which is soluble in water, but not solvents) is used as the viscosity stabilizing agent, it is added to the zinc oxide prior to grinding of the zinc oxide particles to disperse the Versene in the toluene vehicle. Being toluene-insoluble, it is an inert filler until solubilized by the free acid components of the resins. It becomes effective as a chelate for zinc ions only after being solubilized. The coating formulation is applied to the paper at a coat weight of 15 lbs. per 3000 square feet.

The following tabled viscosity stabilizing results were obtained with the afore-described 15 lb. coating formulation:

| Chelate Former | Qty of Chelate Former as a % by Wt. of Zinc Oxide | Viscosity Increases After 1 Hour |
|---|---|---|
| None | 0.0% | 52.8% |
| Ethylenediamine | 0.15% | 6.6% |
| Diethylenetriamine | 0.26% | 9.6% |
| Versena | 1.09% | 5.7% |

As will be appreciated by those skilled in the art, in addition to the zinc oxide disclosed as the photoconductive element of the coating, other metal compounds which are suitable as photoconductive pigments and the metals of which form chelate complexes—e.g., cadmium sulfide, titanium dioxide, mercuric sulfide, etc.—are known. In this respect, Chapter I of "The Analytical Uses of Ethylenediaminetetraacetic Acid", by Frank J. Welcher, Van Nostrand, 1958, enumerates many metals which form stable complexes with the particular chelating agent, for instance. Accordingly, such metal compounds, as well as other modifications evident to those skilled in the art, are intended to fall within the scope of the invention as defined by the appended claims.

What is claimed is:

1. In a liquid dispersion of photoconductive metal-compound particles and a solution of resinous binder containing a particular amount of carboxyl groups, the dispersion being suitable as a photoconductive coating formulation for application to sheet material for coating same, but subject to unstable viscosity caused by metal ions arising from reaction between the carboxyl groups and the photoconductive particles, and the major portion of the liquid being organic, the improvement wherein said dispersion contains a chelating agent in an amount related to the amount of the carboxyl groups, said agent having the property of complexing ions of the metal in said photoconductive metal-compound particles by the formation of a ring structure incorporating the metal ions, thereby stabilizing the viscosity of the dispersion.

2. The dispersion of claim 1 wherein said metal compound is zinc oxide.

3. The dispersion of claim 2 wherein the chelating agent is ethylenediaminetetraacetic acid.

4. In a method for preparing a photoconductive coating material comprising a liquid dispersion of photoconductive metal-compound particles in a solution of resinous binder material containing a particular amount of carboxyl groups and being suitable as a photoconductive coating for sheet material, an organic liquid forming the major portion of the liquid, and the dispersion being subject to unstable viscosity caused by metal ions arising from reaction between the carboxyl groups and photoconductive particles, the step of:

incorporating into said dispersion a chelating agent having the property of complexing ions of the metal in said photoconductive metal-compound particles for stabilizing the viscosity of the coating material, said chelating agent being provided in an amount related to said particular amount of carboxyl groups.

5. The method of claim 4 wherein the metal compound is zinc oxide and the chelating agent has the property of complexing zinc ions by formation of a ring structure incorporating a zinc ion.

6. The method of claim 4 wherein the chelating agent is ethylenediaminetetraacetic acid.

7. The method of claim 4, wherein the chelating agent is formed in situ by incorporating into the dispersion a chelate precursor selected from the group consisting of ethylenediamine, diethylenetriamine, and salts of ethylenediaminetetraacetic acid.

8. The method of claim 7 wherein the chelate percursor reacts with the carboxyl groups of the resin binder to form the chelate and the amount of chelate percursor incorporated is within the range from the stoichiometric quantity needed to react with the carboxyl groups up to a 5 molar excess of such stoichiometric quantity.

9. The method of claim 4 wherein the liquid is toluene and the resinous binder is a copolymer of a monomer and a copolymerizable carboxylic acid, the monomer being taken from the group consisting of a vinyl acetate, an acrylate, and mixtures thereof.

10. The dispersion of claim 2 wherein the chelating agent is one formed in situ, the dispersion initially containing a chelate precursor selected from the group consisting of ethylenediamine, diethylenetriamine, and salts of ethylenediaminetetraacetic acid.

11. The dispersion of claim 10 wherein the chelate precursor reacts with the carboxyl groups of the resin binder to form the chelate and the amount of chelate precursor initially contained is within the range from the stoichiometric quantity needed to react with the carboxyl groups up to a 5 molar excess of such stoichiometric quantity.

12. The dispersion of claim 2 wherein the resinous binder is a copolymer of a monomer and a copolymerizable carboxylic acid, the monomer being taken from the group consisting of a vinyl acetate, an acrylate and mixtures thereof.

13. The method of claim 5 wherein the resinous binder is a copolymer of a monomer and a copolymerizable carboxylic acid, the monomer being taken from the group consisting of a vinyl acetate, an acrylate, and mixtures thereof.

* * * * *